US008410716B2

(12) United States Patent
Yao et al.

(10) Patent No.: US 8,410,716 B2
(45) Date of Patent: Apr. 2, 2013

(54) CONTROL OF MULTI-STRING LED ARRAY

(75) Inventors: Kaiwei Yao, San Jose, CA (US); James C. Moyer, San Jose, CA (US)

(73) Assignee: Monolithic Power Systems, Inc., San Jose, CA (US)

( * ) Notice: Subject to any disclaimer, the term of this patent is extended or adjusted under 35 U.S.C. 154(b) by 569 days.

(21) Appl. No.: 12/641,212

(22) Filed: Dec. 17, 2009

(65) Prior Publication Data

US 2011/0148323 A1 Jun. 23, 2011

(51) Int. Cl.
*H05B 37/02* (2006.01)

(52) U.S. Cl. ..... 315/291; 315/209 R; 315/299; 315/307; 315/312

(58) Field of Classification Search ..... 315/209 R, 315/224–226, 291, 299, 307, 312–315, 360–362
See application file for complete search history.

(56) References Cited

U.S. PATENT DOCUMENTS

2009/0189539 A1* 7/2009 Deng et al. ..... 315/294
2010/0220049 A1* 9/2010 Murakami ..... 345/102
2011/0062872 A1* 3/2011 Jin et al. ..... 315/122

* cited by examiner

*Primary Examiner* — Jimmy Vu
(74) *Attorney, Agent, or Firm* — Perkins Coie LLP

(57) ABSTRACT

Apparatus, systems, and methods related to controlling multiple strings of light emitting diodes (LEDs) are disclosed. An apparatus may include internal current limiter circuits that are each coupled in series with an associated string of LEDs and are configured to at least partially regulate the current through the associated string of LEDs. The apparatus may also be configured to control external current limiter circuits that are each coupled in series with a corresponding internal current limiter circuit and the string of LEDs associated with the corresponding internal current limiter circuit.

26 Claims, 7 Drawing Sheets

CONTROL OF MULTI-STRING LED ARRAY

TECHNICAL FIELD

The present disclosure is directed to control of light emitting diode (LED) arrays and other loads, for example, to current regulation of such loads.

BACKGROUND

Light emitting diode (LED) arrays are commonly employed in a wide range of applications. For example, LED arrays are now employed to provide backlighting for liquid crystal display (LCD) televisions, LCD monitors, LED displays, lighting devices, and/or the like. In systems where numerous LEDs are employed, the LEDs are commonly arranged in multiple strings of LEDs (e.g., to simplify drive and control circuitry while still enabling selective control of portions of the LED array).

BRIEF DESCRIPTION OF THE DRAWINGS

Non-limiting and non-exhaustive embodiments are described with reference to the following drawings. In the drawings, like reference numerals refer to like parts throughout the various figures unless otherwise specified. These drawings are not necessarily drawn to scale. Likewise, the relative sizes of elements illustrated by the drawings may differ from the relative size depicted.

DETAILED DESCRIPTION

Figure 1:
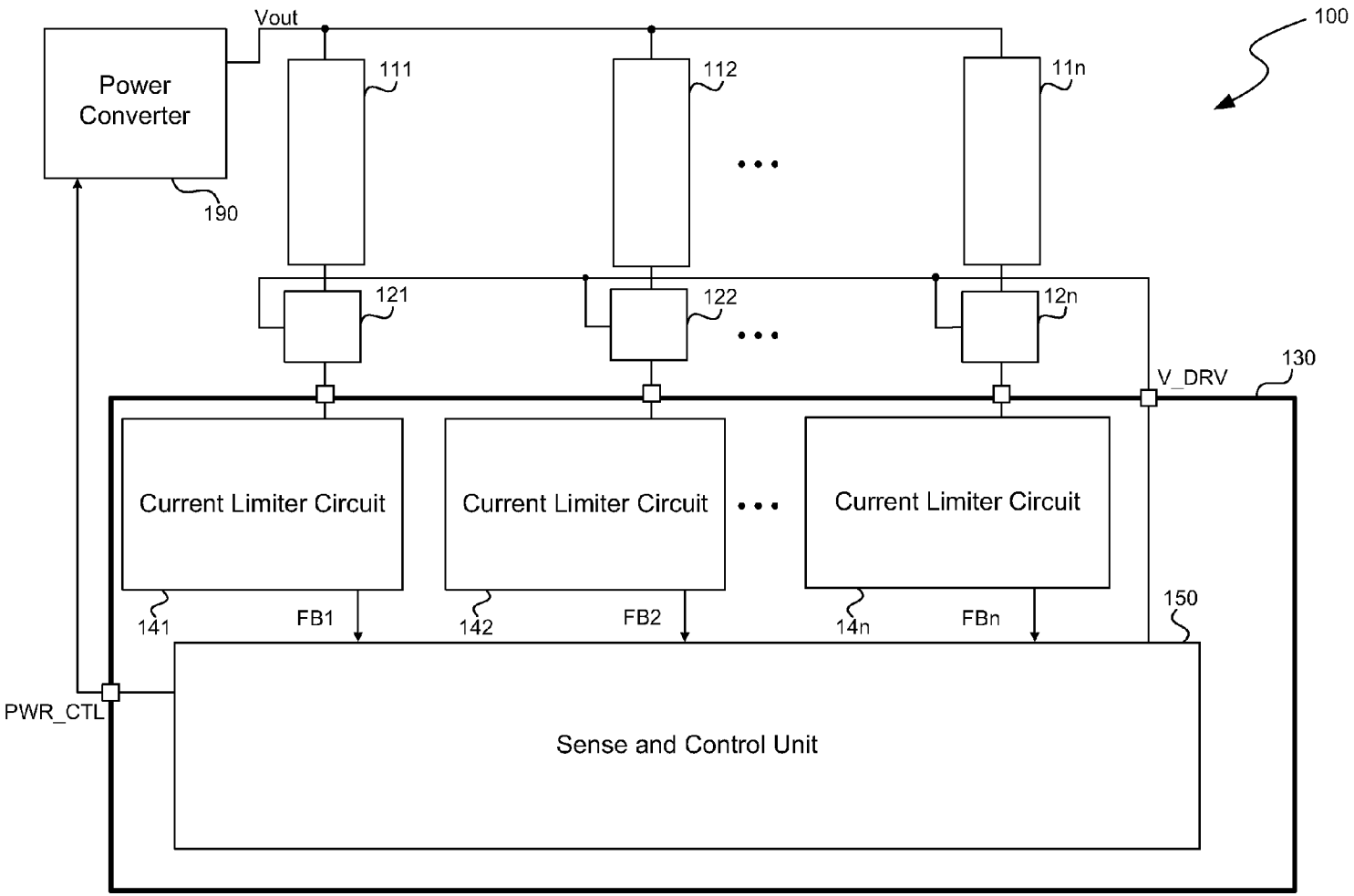
FIGS. 1-2 are block diagrams of exemplary embodiments of systems according to certain aspects of the invention.

The following description provides a description for exemplary embodiments of the technology. One skilled in the art will understand that the technology may be practiced without many or all of the features described herein. In some instances, well-known structures and functions have not been shown or described in detail to avoid unnecessarily obscuring the description of the embodiments of the technology. It is intended that the terminology used in the description presented below be interpreted in its broadest reasonable manner, even though it is being used in conjunction with a detailed description of certain embodiments of the technology. Although certain terms may be emphasized below, any terminology intended to be interpreted in any restricted manner will be overtly and specifically defined as such in this Detailed Description section. The term "based on" or "based upon" is not exclusive and is equivalent to the term "based, at least in part, on" and includes being based on additional factors, some of which are not described herein. The term "coupled" means at least either a direct electrical connection between the items connected, or an indirect connection through one or more passive or active intermediary devices or mediums. The term "circuit" means at least either a single component or a multiplicity of components, either active and/or passive, that are coupled together to provide a desired function or functions. The term "signal" means at least one current, voltage, charge, temperature, data, or other signal. A "signal" may be used to communicate using active high, active low, time multiplexed, synchronous, asynchronous, differential, single-ended, or any other digital or analog signaling or modulation techniques. References in the singular are made merely for clarity of reading and include plural references unless plural references are specifically excluded. Further, references to groups of elements (e.g., loads 111-11*n*, current limiter circuits 121-12*n*, current limiter circuits 141-14*n*, etc.) in collective relation to other groups of elements are made merely for clarity of reading. Such references refer to the relationships of each element of the first group to each respective element of a second group unless specifically indicated otherwise. For example, "loads 111-11*n* are coupled to current limiter circuits 121-12*n*" means that load 111 is coupled to current limiter circuit 121, load 112 is coupled to current limiter circuit 122, and load 11*n* is coupled to current limiter circuit 12*n*. Likewise, references directly to a group may also include individual reference to each element of the group. For example, "loads 111-11*n*" may mean "each of load 111, load 112, and load 11*n*." The term "or" is an inclusive "or" operator and is equivalent to the term "and/or" unless specifically indicated otherwise. In the description that follows, the scope of the term "some embodiments" is not to be so limited as to mean more than one embodiment, but rather, the scope may include one embodiment, more than one embodiment, or perhaps all embodiments.

Some embodiments of apparatus, systems, and methods for controlling multiple strings of light emitting diodes (LEDs) are disclosed. An apparatus may include internal current limiter circuits that are each coupled in series with an associated string of LEDs and are configured to at least partially regulate the current through the associated LED string. The apparatus may also be configured to control external current limiter circuits that are each coupled in series with a corresponding internal current limiter circuit and the LED string associated with the corresponding internal current limiter circuit. The external current limiter circuits may all be configured to be controlled with the same drive signal or several drive signals.

Some embodiments of the technology described herein may be employed to address thermal issues related to regulating currents through multiple LED strings with system controller integrated circuit (IC) having a relatively low pin-count. In an example system, internal current limiter circuits (e.g., internal to the system controller IC) are employed to at least partially regulate current through each of the multiple LED strings. In addition, external current limiter circuits (e.g., current limiter circuits external to the system controller IC) may also be employed to partially regulate currents through each of the multiple LED strings, for example, based on whether the internal current limiter circuits are operating within a regulation range (e.g., with head-room, within a linear operating region, within a middle portion of an operating region, etc.). For example, partial regulation of a current may include controlled blocking of any portion of the voltage dropped in regulating a current, controlled dissipation of any portion of the power lost in regulating a current, and/or the like. The technology may be employed to regulate the current through LED arrays having any number of LED strings.

By employing external current limiter circuits, the heat generated in the system controller IC may be less than if internal current limiter circuits were employed to regulate the currents through the multiple LED strings without also employing external current limiter circuits. In addition, a relatively low pin-count for the system controller IC may be maintained by employing a common/shared drive signal for driving each of the external current limiter circuits.

FIG. 1 is a block diagram of system 100. As illustrated, system 100 includes loads 111-11*n*, current limiter circuits 121-12*n*, system controller 130, and power converter 190. As illustrated, current limiter circuits 121-12*n*, system controller 130, and power converter 190 may be operable to regulate the currents through loads 111-11*n*. System 100 may be configured to provide this functionality with a limited number of interface signals between system controller 130 and the other components of system 100 (e.g., reduced pin-count, relatively simple interface, etc.) while system controller 130 may also be operable as a relatively low thermal dissipation system controller.

In one embodiment, loads 111-11*n* may include any number of LEDs, electroluminescent devices, or other illumination devices, and/or the like, configured as single devices, in strings of devices, in arrays of LEDs, and/or the like. Loads 111-11*n* may also be controlled to provide illumination at any of multiple intensity levels by current limiter circuits 121-12*n*, system controller 130, and power converter 190. As one example, loads 111-11*n* may be controlled to provide any of multiple intensity settings for all loads 111-11*n* or for individual loads. For example, such control over intensity levels may be employed to provide dynamic contrast, to optimize between brightness and power consumption, and/or the like.

While loads 111-11*n* are generally referred to in this Detailed Description section as being illumination devices, loads 111-11*n* may include non-illumination device loads. As one example, non-illumination device loads may include any electrical load through which electrical current may flow. For example, loads 111-11*n* may include electronic devices or circuits such as motors, sensors, transmitters, ICs, batteries, battery chargers, and/or the like.

In one embodiment, current limiter circuits 121-12*n* are coupled in series with loads 111-11*n* and are configured to partially regulate currents through loads 111-11*n*. As illustrated in FIG. 1, current limiter circuits 121-12*n* may be configured to operate as controlled by system controller 130 via common drive signal V_DRV. In other embodiments, one or more drive signals may be employed instead of a common drive signal.

As one example, current limiter circuits 121-12*n* may include electronically controllable switches having electronically controllable impedances. For example, devices having linear active regions may be employed as suitable electronically controllable switches. Such devices may include insulated-gate bipolar transistors (IGBTs), junction field effect transistors (JFETs), bipolar junction transistors (BJTs), metal oxide semiconductor field effect transistors (MOSFETs), metal semiconductor field effect transistors (MESFETs), and/or the like. Other devices such as linear current regulators and other current regulators may also be suitably employed.

As one example, system 100 may be configured such that current limiter circuits 121-12*n* provide a majority of the power dissipation and/or voltage dropping as compared to current limiter circuits 141-14*n*. With such an example, devices having relatively high-power handling characteristics may be employed as current limiter circuits 121-12*n*. In this manner, a portion of the overall heat generated in system 100 may be generated by current limiter circuits 121-12*n* rather than by system controller 130.

System controller 130 may be configured to regulate the currents through loads 111-11*n* by (1) employing internal current limiter circuits to perform at least partial current regulation, (2) controlling current limiter circuits 121-12*n* to perform additional partial current regulation, and/or (3) by controlling the power conversion operations of power converter 190. As shown, system controller 130 includes current limiter circuits 141-14*n* and sense and control unit 150.

System controller 130 may be embodied in a monolithic IC, in an application specific integrated circuit (ASIC), and/or the like. System controller 130 may also be fully or partially embodied as discrete components, as a circuit board assembly, and/or the like. In these and other embodiments, system controller 130 may have a relatively low pin-count and/or a relatively simple interface with the rest of system 100.

As shown in FIG. 1, current limiter circuits 141-14*n* are internal to system controller 130 and may be configured to be coupled in series to loads 111-11*n* and current limiter circuits 121-12*n* in any serial configuration. Loads 111-11*n*, current limiter circuits 121-12*n*, and current limiter circuits 141-14*n* may be serially coupled in any order. In other embodiments, loads 111-11*n*, current limiter circuits 121-12*n*, and current limiter circuits 141-14*n* may be coupled in configurations other than series configurations. Current limiter circuits 141-14*n* may also be configured to at least partially regulate the currents through loads 111-11*n*. In comparison to current limiter circuits 121-12*n*, current limiter circuits 141-14*n* may have relatively low-power handling characteristics.

Further, system controller 130 may also include sense and control unit 150, which may be configured to control current limiter circuits 121-12*n* via common drive signal V_DRV, and to control power converter 190 via power converter control signal PWR_CTL. Sense and control unit 150 may also be configured to provide both common drive signal V_DRV and power converter control signal PWR_CTL based on a voltage differential across at least one of current limiter circuits 141-14*n*, for example, as received via one of signals FB1-FBn.

In addition, sense and control unit 150, current limiter circuits 141-14*n*, or other elements may further include protection circuitry or logic to disable currents through any of loads 111-11*n* if an error condition occurs. Potential error conditions may include open or short circuit conditions in any of loads 111-11*n* or other circuitry, over or under temperature conditions of current limiter circuits 121-12*n* or other circuitry, and/or any other conditions.

As shown in FIG. 1, system 100 also includes power converter 190, which may be configured to provide a substantially constant supply voltage Vout to loads 111-11*n* under the control of power converter control signal PWR_CTL. Power converter 190 may also output voltage Vout of any magnitude or polarity suitable for a selected application.

As one example, power converter 190 may include a switched mode power supply configured to provide a direct current (DC) voltage of a suitable value to loads 111-11*n*. To provide some examples, power converter 190 may include a boost converter, a buck converter, a buck/boost converter, a fly-back converter, an inverting converter, a push-pull converter, and/or the like.

Further, system controller 130 and power converter 190 may be interfaced via additional power converter control signals. For example, system controller 130 may provide control signals for a boost regulator's synchronous switch, asynchronous switch, safety disconnect switch, to configure and/or compensate for frequency characteristics, and/or the like. Power converter 190 may also be configured to provide a current sense signal, an over-voltage protection sensing signal, other feedback signals, and/or the like, to system controller 130.

In one embodiment, power converter 190 is a boost converter configured to provide a DC voltage of between approximately 30 volts and 100 volts to drive a multi-string LED array of an LCD television or LCD monitor.

Figure 2:
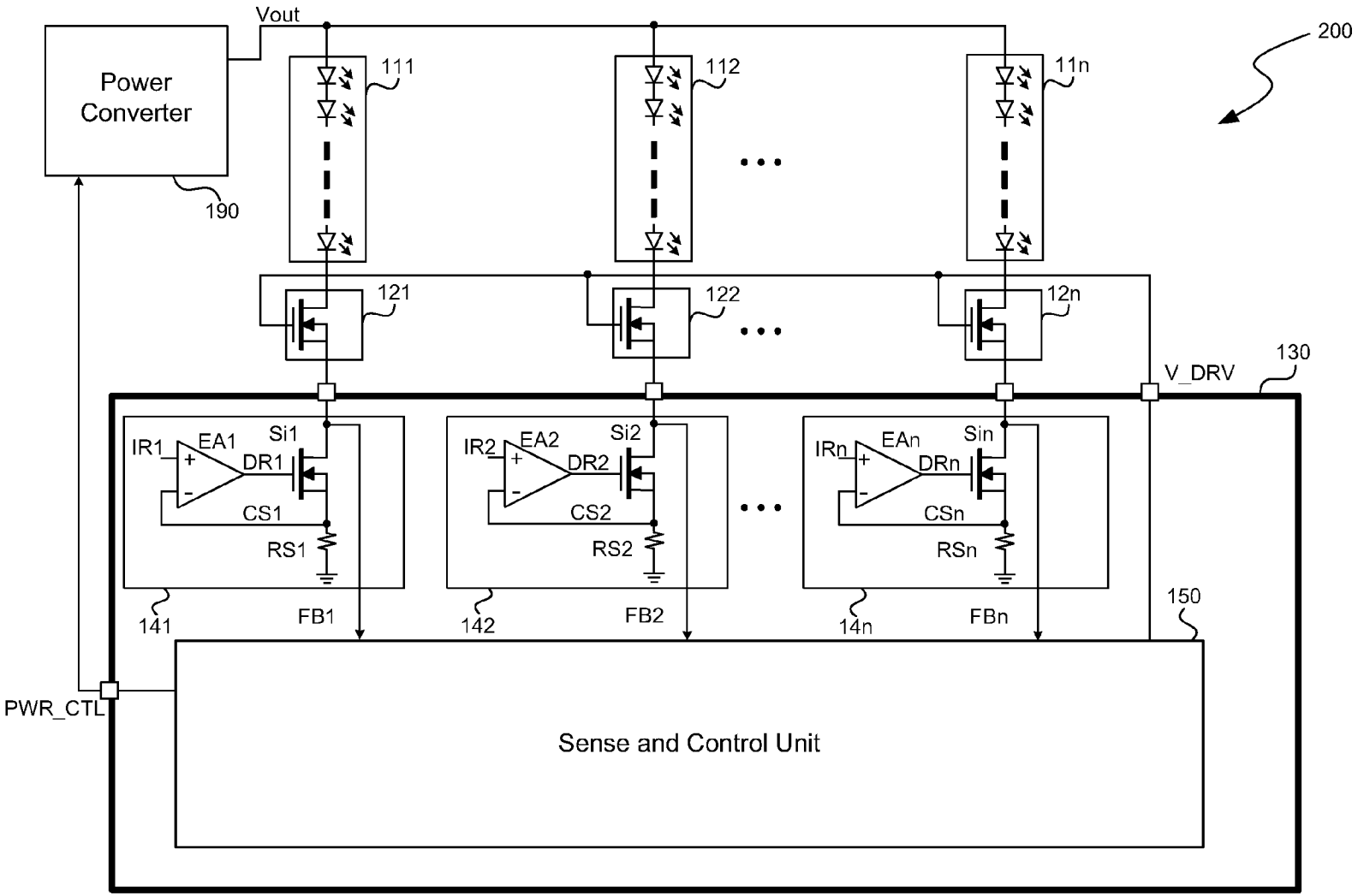

FIG. 2 is a block diagram of system 200. System 200 may be an embodiment of system 100. In an embodiment illustrated by FIG. 2, loads 111-11*n* are serially connected LED strings, current limiter circuits 121-12*n* are N-Channel MOSFET switches, and current limiter circuits 141-14*n* are linear regulators.

As shown, current limiter circuits 141-14*n* include sense resistors RS1-RSn, error amplifiers EA1-EAn, and internal switches Si1-Sin. Current limiter circuits 141-14*n* may also be configured to perform closed loop regulation of the currents through internal switches Si1-Sin based on the value of sense resistors RS1-RSn and the value of reference signals IR1-IRn.

Sense resistors RS1-RSn are configured to provide current sense signals CS1-CSn to the inverting inputs of error amplifiers EA1-EAn based on the currents through sense resistors RS1-RSn. Sense resistors RS1-RSn may be of any suitable type and/or value and may be selected based on expected or designed ranges of currents through loads 111-11*n*.

Error amplifiers EA1-EAn may be configured to receive reference signals IR1-IRn and current sense signals CS1-CSn, and to provide pass transistor control signals DR1-DRn based on a comparison of reference signals IR1-IRn and current sense signals CS1-CSn. Error amplifiers EA1-EAn may also include operational amplifiers, instrumentation amplifiers, differential amplifiers, and/or the like and circuits thereof.

Internal switches Si1-Sin may be configured as pass transistors coupled in series with loads 111-11*n* to partially regulate the currents through loads 111-11*n* based on pass transistor control signals DR1-DRn from error amplifiers EA1-EAn. While internal switches Si1-Sin are illustrated as being N-Channel MOSFET switches, any suitable types of switches may be employed.

Although illustrated as linear current regulators, current limiter circuits 141-14*n* may include other types of current limiter circuits. For example, switches (such as the switches discussed above with respect to current limiter circuits 121-12*n*), current mirrors, and/or the like, may be employed in other embodiments.

In operation, current limiter circuits 121-12*n* and current limiter circuits 141-14*n* may function together to regulate the currents though loads 111-11*n*. As an example of the combined operation of these circuits, when a given one of signals FB1-FBn is low, the corresponding external switch may be fully on and the corresponding internal linear regulator may fully and/or primarily regulate the current for the associated load. As the given one of signals FB1-FBn increases, the gate-to-source voltage of the corresponding external switch may decrease such that it enters a linear region and drops more voltage while the corresponding internal linear regulator begins to only partially regulate the associated load. For a gate-to-source threshold voltage equaling Vth, the maximum voltage drop of any of the internal linear regulators may be V_DRV-Vth, which may be significantly less than if only internal linear regulators were employed to regulate the currents to loads 111-11*n*.

Although not shown, system 200 may also include circuitry and/or functionality to provide selective dimming of each of loads 111-11*n* independent of each of the other loads. For example, system 200 may include additional control circuitry to selectively open and close internal switches Si1-Sin as controlled by, for example, a pulse width modulation (PWM) or other controller. Likewise, system 200 may include circuitry and/or functionality to provide selective black-outs or blanking. As one example, common drive signal V_DRV may be pulled low to disable current through all of loads 111-11*n* at the same time. Such circuitry or functionalities may be controlled from within system controller 130, via an external signal, within sense and control unit 150, and/or the like.

Figure 3:
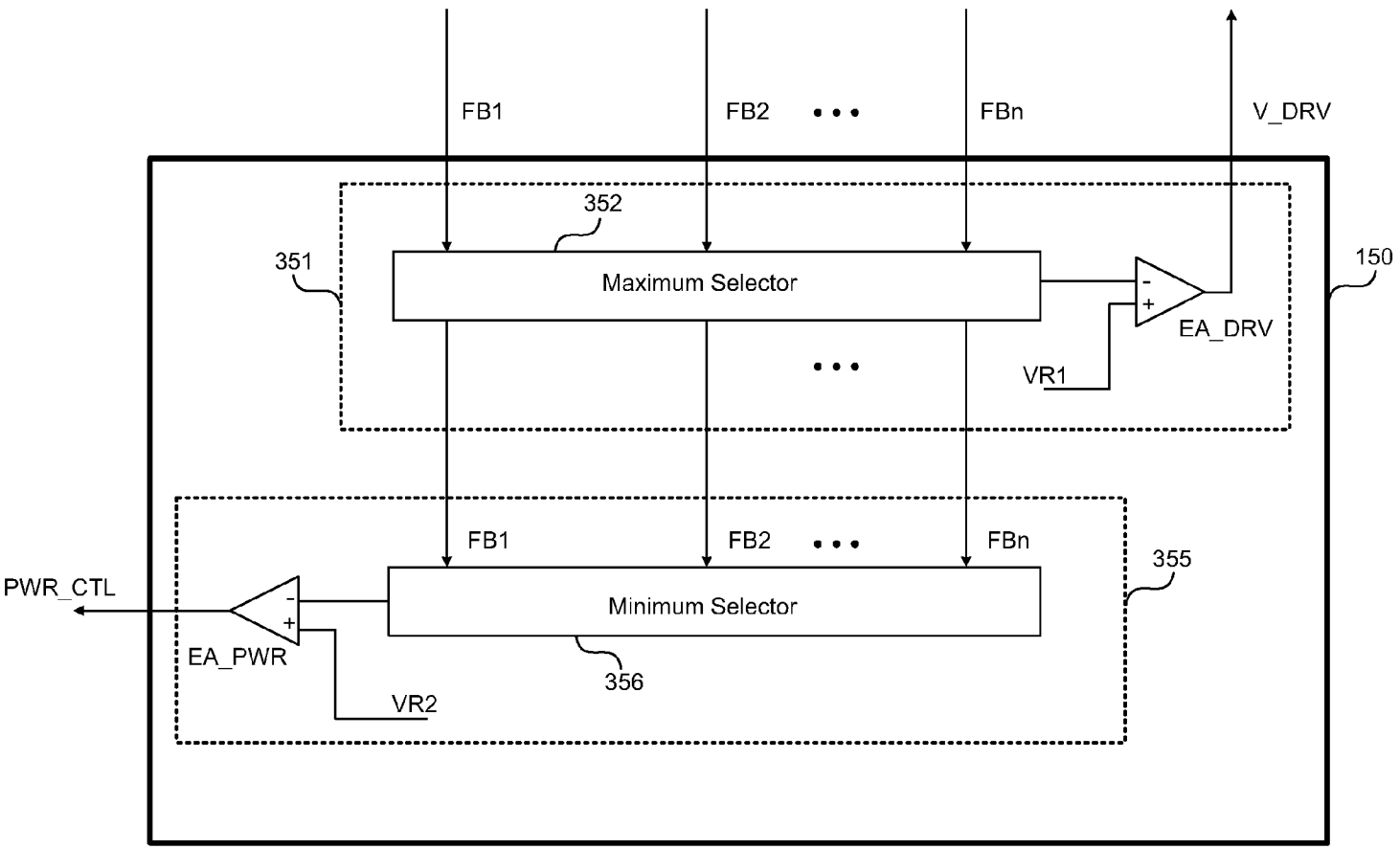
FIG. 3 is a block diagram of the sense and control unit of FIGS. 1 and 2 according to certain aspects of the invention.

FIG. 3 is a block diagram of sense and control unit 150 of FIGS. 1 and 2. As illustrated, sense and control unit 150 includes current limiter drive control unit 351 and power converter controller 355. As illustrated, current limiter drive control unit 351 includes maximum selector 352 and error amplifier EA_DRV, and power converter controller 355 includes minimum selector 356 and error amplifier EA_PWR.

As discussed above, sense and control unit 150 may be configured to control current limiter circuits 121-12*n* via common drive signal V_DRV based on a voltage differential across at least one of current limiter circuits 141-14*n*, for example, as received via one of signals FB1-FBn.

To provide this functionality, current limiter drive control unit 351 may be configured to sense voltage differentials across each of current limiter circuits 141-14*n* by monitoring signals FB1-FBn with maximum selector 352. Alternately, current limiter drive control unit 351 may be configured to sense voltage differentials across each of current limiter circuits 121-12*n* or to sense voltage differentials across each combination of current limiter circuits 141-14*n* and corresponding ones of current limiter circuits 121-12*n* (e.g., the sum of the voltage across current limiter circuit 121 and the voltage across current limiter circuit 141, the sum of the voltage across current limiter circuit 122 and the voltage across current limiter circuit 142, etc.).

Maximum selector 352 may also be configured to provide the largest of these differentials/signals to error amplifier EA_DRV for comparison to reference signal VR1. Based on this comparison, error amplifier EA_DRV may provide common drive signal V_DRV. In this manner, the voltages across each of current limiter circuits 141-14*n* may be less than the voltage of reference signal VR1, and may thus limit the power dissipated within system controller 130. In addition, use of the closed-loop feedback system of current limiter drive control unit 351 may enable sense and control unit 150 to adjust for current limiter circuits 121-12*n* having different threshold voltages, temperature-related characteristics, manufacturing characteristics, operational characteristics, and/or the like.

Any suitable circuits or devices may be employed as maximum selector 352 or error amplifier EA_DRV. As one example, a common cathode voltage follower circuit may be employed as maximum selector 352.

Although not shown, current limiter drive control unit 351 may also be configured to provide common drive signal V_DRV from a programmable value, as a fixed value, and/or the like. In such embodiments, common drive signal V_DRV may be provided based on, for example, threshold voltages of current limiter circuits 121-12*n*, based on information received via a Serial peripheral Interface (SPI) or Inter-Integrated Circuit (I2C) interface, and/or the like. In addition, impedances (e.g., resistors, inductors, capacitors, other passive and/or active intermediary devices, etc.) may be provided between current limiter drive control unit 351 and current limiter circuits 121-12*n*.

As also discussed above, sense and control unit 150 may be configured to control power converter 190 via power converter control signal PWR_CTL based on a voltage differential across at least one of current limiter circuits 141-14*n*, for example, as received via one of signals FB1-FBn.

To provide this functionality, power converter controller 355 may be configured to sense voltage differentials across each of current limiter circuits 141-14*n* by monitoring signals FB1-FBn with minimum selector 356. Alternately, power converter controller 355 may be configured to sense voltage differentials across each of current limiter circuits 121-12*n* or to sense voltage differentials across each combination of current limiter circuits 141-14*n* and corresponding ones of current limiter circuits 121-12*n*. Minimum selector 356 may also be configured to provide the smallest of these differentials/signals to error amplifier EA_PWR for comparison to reference signal VR2. Based on this comparison, error amplifier EA_PWR may then provide power converter control signal PWR_CTL. In operation, power converter controller 355 may drive supply voltage Vout to a closed-loop level sufficient or just sufficient enough to provide full operating voltage for all of loads 111-11*n*.

Any suitable circuit or device may be employed as minimum selector 356 or error amplifier EA_PWR. As one example, a common anode voltage follower circuit may be employed as minimum selector 356.

Figure 4:
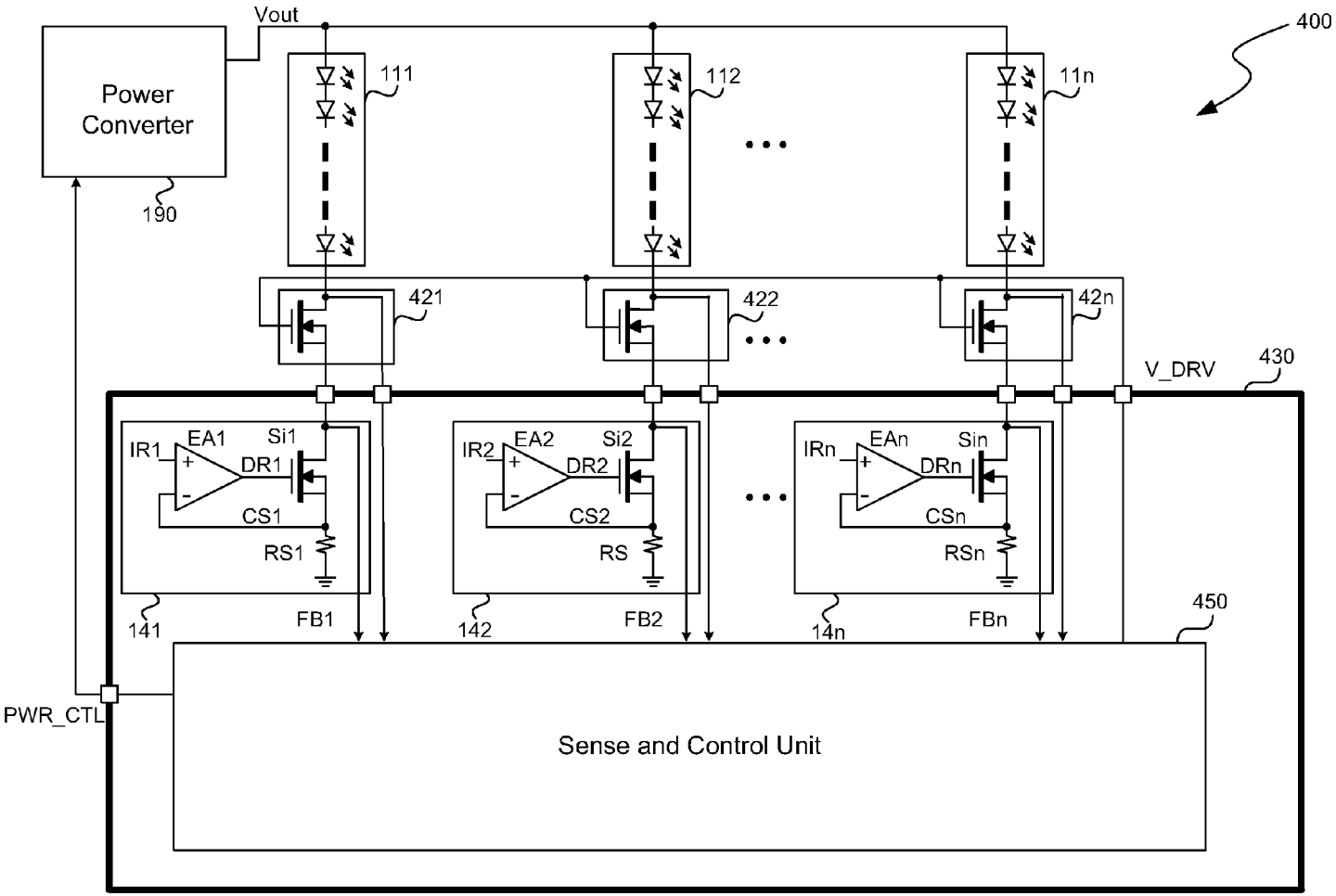
FIGS. 4-7 are block diagrams of additional exemplary embodiments of systems according to certain aspects of the invention.

FIG. 4 is a block diagram of system 400. As shown, system 400 differs from system 100 of FIG. 1 and system 200 of FIG. 2 in that current limiter circuits 421-42*n* are configured to additionally provide drain sense signals to sense and control unit 450 of system controller 430.

In addition, sense and control unit 450 may be configured to sense the power dissipated by each of current limiter circuits 421-42*n*, and to disable the current through the load coupled to a given current limiter circuit if the sensed power dissipation is greater than a threshold value. Likewise, sense and control unit 450 may alternatively be configured to sense the voltage across each of current limiter circuits 421-42*n* and to disable the current through the load coupled to a given current limiter circuit if the sensed voltage across the given current limiter circuit is less than a threshold value.

In operation, this additional feature may increase the ability of the circuitry to detect excessive current or other faults in an illumination system and may function as a safety mechanism to prevent the burnout of components (e.g., loads 111-11*n*, current limiter circuits 421-42*n*, system controller 430, power converter 190, etc.), or to prevent a fire risk or other safety hazard.

Figure 5:
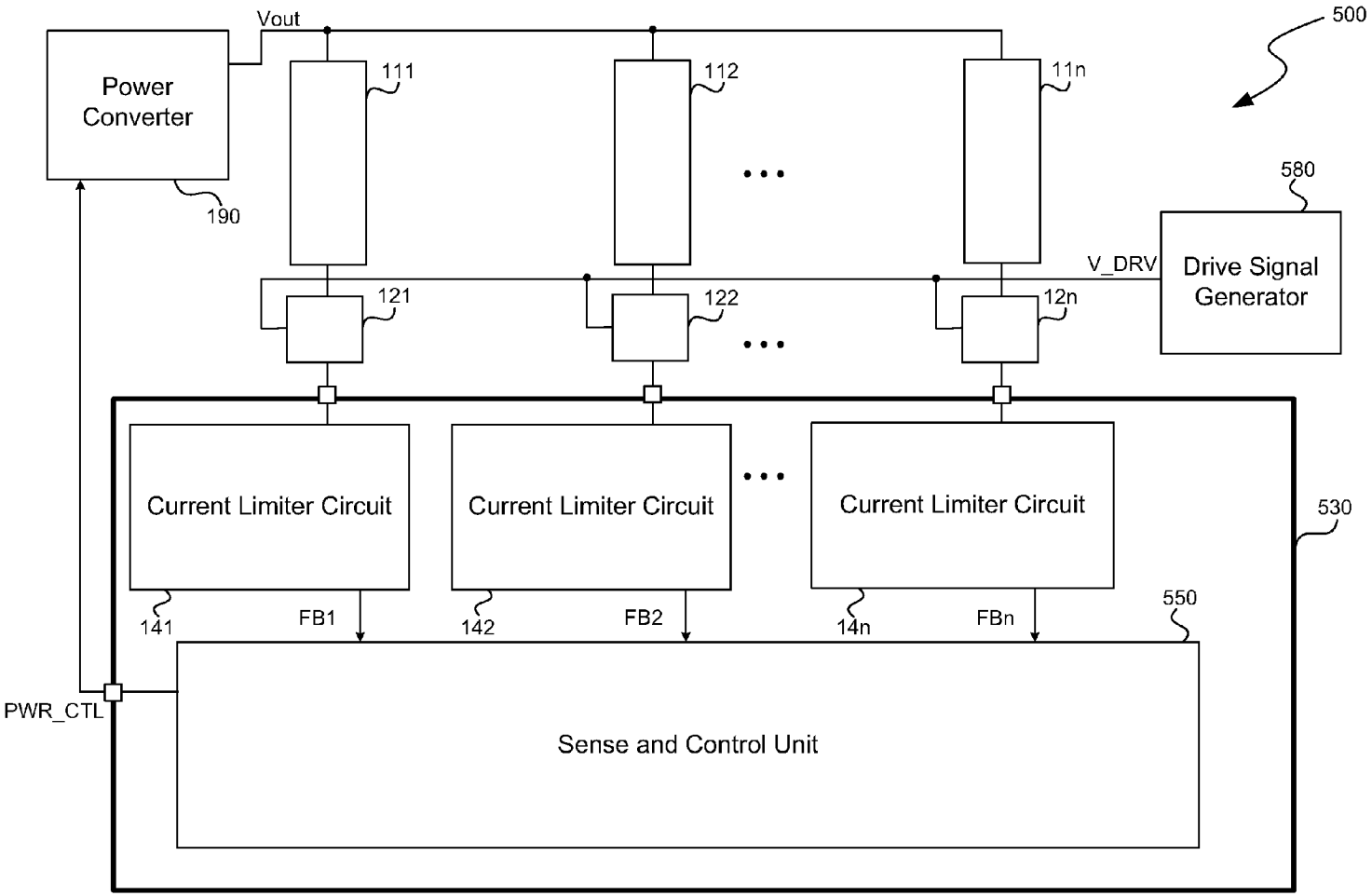

FIG. 5 is a block diagram of system 500. As shown, system 500 differs from system 100 of FIG. 1 and system 200 of FIG. 2 in that common drive signal V_DRV is provided by external drive signal generator 580 rather than by sense and control unit 550 of system controller 530.

In an embodiment of system 500, drive signal generator 580 may provide common drive signal V_DRV as a programmable or fixed value signal from a voltage divider, a digital to analog converter (DAC), a reference voltage source, and/or the like. If, for example, drive signal generator 580 provides common drive signal V_DRV from a DAC, drive signal generator 580 may be further configured to receive a digital control signal from a microprocessor, microcontroller, digital signal processor, and/or the like. As some examples, a digital control signal may be an I2C signal, a SPI signal, and/or the like.

Further, a value of common drive signal V_DRV may be selected based on a threshold value characteristic of switches of current limiter circuits 121-12*n* or be selected to define the power dissipated, or voltage dropped, by system controller 530 versus current limiter circuits 121-12*n* while providing at least a threshold level of current flow through loads 111-11*n*.

Figure 6:
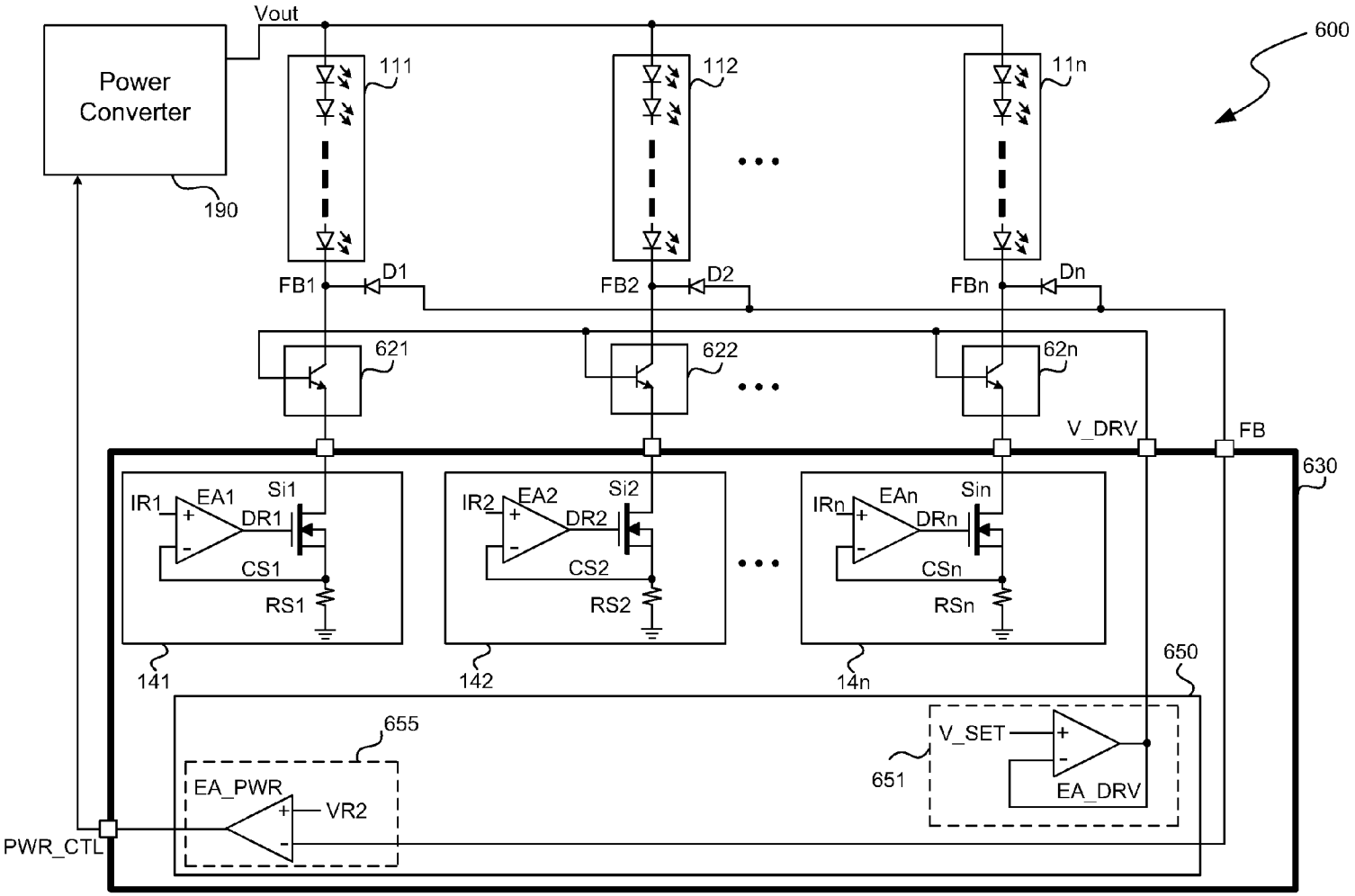
Figure 7:
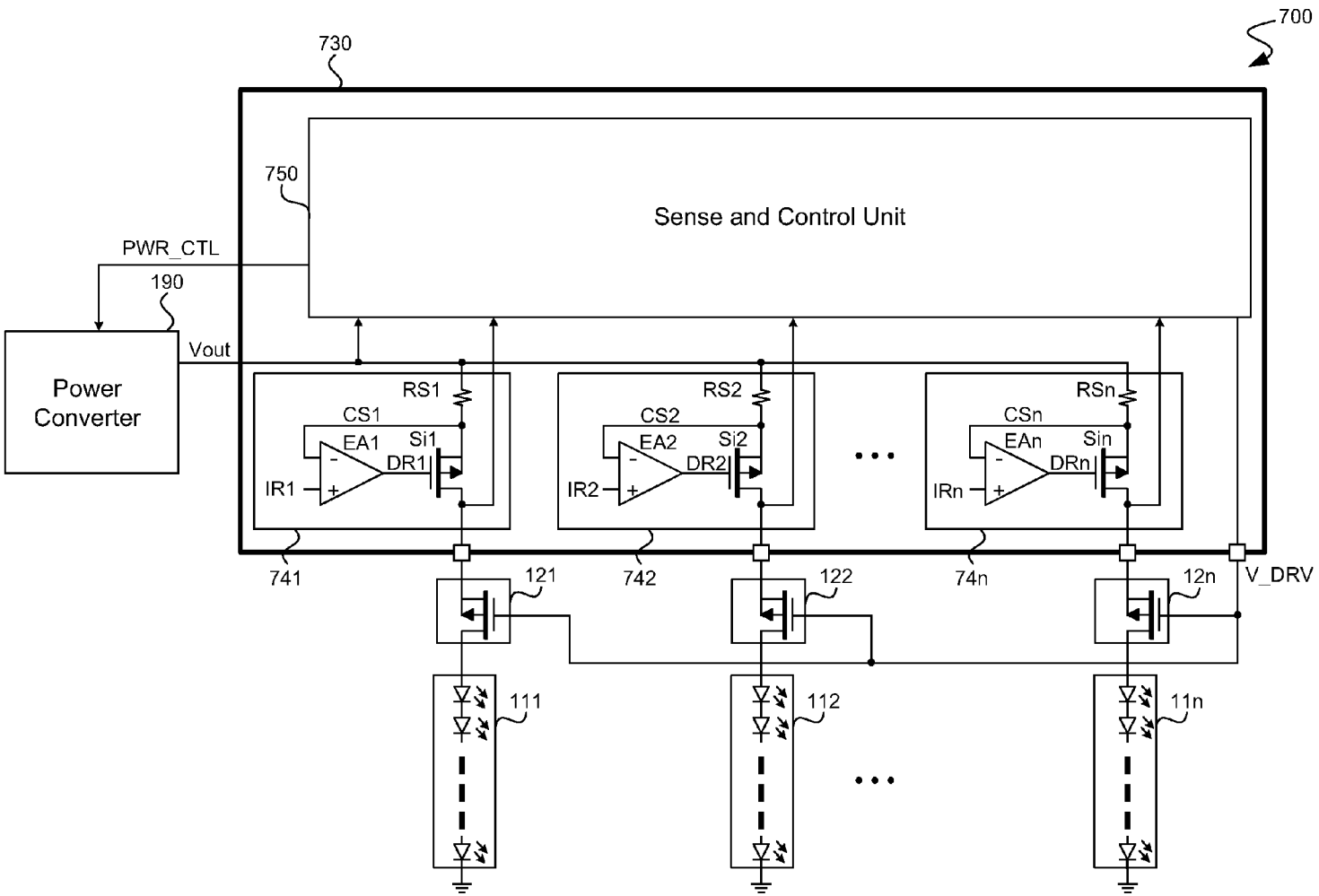

FIG. 6 is a block diagram of system 600. As shown, system 600 differs from system 100 of FIG. 1 and system 200 of FIG. 2 in that BJTs are employed in current limiter circuits 621-62*n* instead of the N-Channel MOSFETs of current limiter circuits 121-12*n*. In addition, current limiter circuits 621-62*n* may provide collector voltages as signals FB1-FBn and diodes D1-Dn may be employed as a common anode voltage follower circuit to provide signal FB to error amplifier EA_PWR of power converter controller 655. Also, common drive signal V_DRV may be provided by a voltage follower configured error amplifier EA_DRV based on setpoint signal V_SET. Setpoint signal V_SET may be provided as a programmable or fixed value signal from a voltage divider, a DAC, a reference voltage source, and/or the like. Setpoint signal V_SET may also be based on a digital control signal from a microprocessor, microcontroller, digital signal processor, and/or the like FIG. 7 is a block diagram of system 700. As shown, system 700 differs from system 100 of FIG. 1 and system 200 of FIG. 2 in that system controller 730 is a high-side system controller that is coupled, relative to power converter 190, above current limiter circuits 121-12*n*. Accordingly, system controller 730 includes high-side current limiter circuits 741-74*n* and high-side sense and control unit 750. System 700 also includes cathode-connected low-side current limiter circuits 121-12*n* that are coupled to the cathodes of loads 111-11*n* and, relative to power converter 190, below system controller 730. As shown, current limiter circuits 121-12*n* also include P-Channel MOSFET switches. In other embodiments, loads may be coupled to a high-side system controller, and current limiter circuits external to the system controller may be coupled between ground and anodes of the loads (e.g., anode-connected low-side). In yet other embodiments, a low-side system controller may be coupled to loads, and current limiter circuits external to the load may be coupled between supply voltage Vout and cathodes of the loads (e.g., cathode-connected high-side).

While the above Detailed Description describes certain embodiments, and describes the best mode contemplated, the present invention is not limited to the features described and may be practice in many ways. Details of the system may vary in implementation, while still being encompassed by the present invention disclosed herein. As noted above, particular terminology used when describing certain features or aspects of the present invention should not be taken to imply that the terminology is being redefined herein to be restricted to any specific characteristics, features, or aspects of the present invention with which that terminology is associated. In general, the terms used in the following claims should not be construed to limit the present invention to the specific embodiments disclosed in the specification, unless the above Detailed Description explicitly defines such terms. Accordingly, the scope of the present invention encompasses not only the disclosed embodiments, but also all equivalent ways of practicing or implementing the present invention under the claims. Further, the claims below are incorporated herein as additional exemplary embodiments of the present invention.

We claim:

1. An apparatus for regulating currents through two or more loads, comprising:

a first set of two or more current limiter circuits, wherein each of the current limiter circuits of the first set is configured to be coupled in series with an associated load, and is further configured to at least partially regulate the current through the associated load;

a second set of two or more current limiter circuits, wherein each of the current limiter circuits of the second set is configured to be coupled in series with the associated load, and wherein each of the current limiter circuits of the second set is corresponding to, and coupled in series with, each of the current limiter circuits of the first set; and a sense and control unit configured to provide one or more drive signals to the current limiter circuits of the second set; and wherein the sense and control unit is further configured to control a power converter that is configured to supply power to each of the loads based on a signal from one of the current limiter circuits of the first or second sets, and the sense and control unit is further configured to sense voltage differentials across each of the current limiter circuits of the first set or the second set, and to control the power converter based on a comparison of the smallest of the voltage differentials to a power converter reference signal.

2. The apparatus of claim 1, wherein each of the current limiter circuits of the second set is configured to partially regulate, based on the one or more drive signals, the current through the load associated with the corresponding current limiter circuit of the first set if any of the current limiter circuits of the first set are not fully regulating the current through the associated load.

3. The apparatus of claim 1, wherein each of the current limiter circuits of the second set is configured to partially regulate, based on the one or more drive signals, the current through the load associated with the corresponding current limiter circuit of the first set.

4. The apparatus of claim 1, wherein each of the current limiter circuits of the first set is configured as a linear current regulator, including:

a current sense resistor configured to provide a current sense signal based on a current through the current sense resistor;

an error amplifier configured to receive a reference signal and the current sense signal, and to provide a pass transistor control signal based on a comparison of the reference signal and the current sense signal; and a pass transistor configured to be coupled in series with the associated load, and configured to at least partially regulate the current through the associated load based on the pass transistor control signal.

5. The apparatus of claim 1, wherein each of the current limiter circuits of the first set includes at least one of an insulated-gate bipolar transistor (IGBT), a junction field effect transistor (JFET), a bipolar junction transistor (BJT), a metal oxide semiconductor field effect transistor (MOSFET), a metal semiconductor field effect transistor (MESFET), or a current regulator.

6. The apparatus of claim 1, wherein the sense and control unit is further configured to sense voltage differentials across each of the current limiter circuits of the first set in combination with the corresponding current limiter circuit of the second set and to control the power converter based on a comparison of the smallest of the voltage differentials to the power converter reference signal.

7. The apparatus of claim 1, further comprising:

the power converter, wherein the power converter is a boost power converter that is configured to provide direct current (DC) power to the loads based on one or more power converter control signals from the sense and control unit.

8. The apparatus of claim 1, wherein the sense and control unit includes:

a current limiter drive control unit that is configured to sense voltage differentials across each of the current limiter circuits of the first set and to provide the one or more drive signals based on a sensed voltage differential.

9. The apparatus of claim 8, wherein the current limiter drive control unit is further configured to provide the one or more drive signals based on a comparison of the largest of the sensed voltage differentials to a reference voltage.

10. The apparatus of claim 1, wherein the sense and control unit includes:

a current limiter drive control unit that is configured to provide the one or more drive signals based on at least one of a programmable value, a fixed value, or a closed-loop feedback value.

11. The apparatus of claim 1, wherein the sense and control unit is further configured to sense a power dissipated by each of the current limiter circuits of the second set, and if the sensed power dissipation is greater than a threshold value, to disable the current through the load associated with the corresponding current limiter circuit of the first set.

12. The apparatus of claim 1, wherein the loads are light emitting diode (LED) strings comprising one or more LEDs, and wherein and the sense and control unit is further configured to selectively black-out the LED strings by simultaneously disabling each current limiter circuit of the second set via the one or more drive signals.

13. The apparatus of claim 1, wherein each of the loads is a string of serially connected light emitting diodes (LEDs).

14. The apparatus of claim 1, wherein the one or more drive signals comprise a common drive signal.

15. The apparatus of claim 1, wherein the first set of current limiter circuits are internal to an integrated circuit, and the second set of current limiter circuits are external to the integrated circuit.

16. An illumination system, comprising:

a system controller integrated circuit (IC), including:

an internal set of two or more current limiter circuits, wherein each of the internal current limiter circuits is configured to be coupled in series with an associated load, and is further configured to at least partially regulate a current through the associated load;

an external set of current limiter circuits, wherein each of the external current limiter circuits is coupled in series with a corresponding current limiter circuit of the internal set, and is configured to be coupled in series with the associated load of the corresponding internal current limiter circuit; and a sense and control unit configured to control a power converter that is configured to supply power to each of the loads based on a signal from one of the current limiter circuits of the internal sets or external sets, and the sense and control unit is further configured to sense voltage differentials across each of the current limiter circuits of the internal set or the external set, and to control the power converter based on a comparison of the smallest of the voltage differentials to a power converter reference signal.

17. The system of claim 16, wherein the sense and control unit is further configured to provide a shared drive signal to each of the current limiter circuits of the external set, and wherein all of the current limiter circuits of the external set are configured to be controlled by the shared drive signal.

18. The system of claim 17, wherein the shared drive signal generator includes at least one of a voltage divider, a digital to analog converter, or a reference voltage source.

19. The system of claim 16, further comprising a shared drive signal generator that is external to the system controller IC and that is configured to provide a shared drive signal to each of the current limiter circuits of the external set.

20. The system of claim 16, wherein the system controller IC further includes:

a power converter controller configured to provide one or more power converter control signals to the power converter based on a voltage differential across at least one of the internal current limiter circuits or one of the external current limiter circuits, wherein the system further comprises:

the power converter configured to provide direct current (DC) voltage to the loads based on the one or more power converter control signals.

21. The system of claim 16, wherein the system controller IC further includes:

a power converter controller configured to provide one or more power converter control signals to the power converter based on a voltage differential across at least a combination of an internal current limiter circuit and the external current limiter circuit corresponding to the internal current limiter circuit, wherein the system further comprises:

the power converter configured to provide direct current (DC) voltage to the loads based on the one or more power converter control signals.

22. The system of claim 16, wherein the external set of current limiter circuits are cathode-connected high-side switches, cathode-connected low-side switches, anode-connected high-side switches, or anode-connected low-side switches.

23. A method of regulating currents through two or more loads, comprising:

fully or partially regulating a current through a first load with a first current limiter circuit that is in series with the first load;

fully or partially regulating a current through a second load with a second current limiter circuit that is in series with the second load;

partially regulating the current through the first load with a third current limiter circuit that is in series with both the first load and the first current limiter circuit if either of the first or second current limiter circuits is partially regulating the current through either the first or the second load; and partially regulating the current through the second load with a fourth current limiter circuit that is in series with both the second load and the second current limiter circuit if either of the first or second current limiter circuits is partially regulating the current through either the first or the second load;

sensing voltage differentials across the first current limiter circuit and the second current limiter circuit; and controlling a power converter based on the comparison of the smallest of the voltage differentials to a power converter reference signal.

24. The method of claim 23, wherein the second current limiter circuit and the fourth current limiter circuit are both controlled by a control signal.

25. An apparatus for regulating currents through two or more loads, comprising:

a first set of two or more current limiter circuits, wherein each of the current limiter circuits of the first set is configured to be coupled in series with an associated load;

a second set of current limiter circuits, wherein each of the current limiter circuits of the second set is configured to be coupled in series with a corresponding current limiter circuit of the first set, wherein each current limiter circuit of the first set, in conjunction with the corresponding current limiter circuit of the second set, is further configured to regulate the current through a serially coupled load; and a sense and control unit configured to control a power converter that is configured to supply power to each of the loads based on a signal from one of the current limiter circuits of the first or second sets, and the sense and control unit is further configured to sense voltage differentials across each of the current limiter circuits of the first set in combination with the corresponding current limiter circuit of the second set and to control the power converter based on a comparison of the smallest of the voltage differentials to a power converter reference signal.

26. The apparatus of claim 25, further comprising:

the sense and control unit configured to provide a common drive signal to each current limiter circuit of the second set.

* * * * *